US005186615A

United States Patent [19]

Karliner

[11] Patent Number: 5,186,615

[45] Date of Patent: Feb. 16, 1993

[54] DIAPHRAGM PUMP

[75] Inventor: Rudolf R. Karliner, Minnetonka, Minn.

[73] Assignee: Karldom Corporation, Wacconia, Minn.

[21] Appl. No.: 543,500

[22] Filed: Jun. 26, 1990

[51] Int. Cl.[5] ..... F04B 9/08

[52] U.S. Cl. ..... 417/387; 417/395; 92/98 R

[58] Field of Search ..... 417/387, 395; 92/98 R, 92/99

[56] References Cited

U.S. PATENT DOCUMENTS

| | | | |
|---|---|---|---|
| 2,741,205 | 4/1956 | Paulton | 92/98 R |
| 3,218,978 | 11/1965 | Kalert, Jr. | 417/395 |
| 3,291,055 | 12/1966 | Limpert et al. | 417/395 |
| 3,338,170 | 8/1967 | Swartz . | |
| 3,354,831 | 11/1967 | Acker et al. | 417/387 |
| 3,416,453 | 12/1968 | Feuillebois et al. . | |
| 3,433,161 | 3/1969 | Vetter . | |
| 3,680,981 | 8/1972 | Wagner | 417/395 |
| 3,715,174 | 2/1973 | Davis et al. | 417/395 |
| 3,779,384 | 12/1973 | Stahlkopf . | |
| 3,825,154 | 7/1974 | Jaeger | 417/395 |
| 3,961,860 | 6/1976 | Ernst . | |
| 4,021,157 | 5/1977 | Elderfield | 417/395 |
| 4,022,381 | 5/1977 | Karliner . | |
| 4,184,809 | 1/1980 | Kelley . | |
| 4,334,838 | 6/1982 | Fessler et al. | 417/395 |
| 4,353,684 | 10/1982 | Christman . | |
| 4,378,201 | 3/1983 | Quarve . | |
| 4,403,924 | 9/1983 | Gebauer et al. . | |
| 4,564,340 | 1/1986 | Stahlkopf . | |
| 4,619,589 | 10/1986 | Muller et al. . | |
| 4,666,166 | 5/1987 | Hart et al. | 92/99 |

FOREIGN PATENT DOCUMENTS

| | | | |
|---|---|---|---|
| 3000142 | 7/1981 | Fed. Rep. of Germany | 417/395 |
| 0122787 | 7/1984 | Japan | 417/395 |

*Primary Examiner*—Richard A. Bertsch
*Assistant Examiner*—Michael I. Kocharev
*Attorney, Agent, or Firm*—Woodard, Emhardt, Naughton, Moriarty & McNett

[57] ABSTRACT

A diaphragm pump includes upper and lower pump bodies clamping a diaphragm therebetween which separates a driving fluid chamber in the upper body from a pump chamber in the lower body, each body having gripping ridges surrounding the chamber; a driving fluid reservoir in the upper pump body; an outlet check valve having a seat, a closure member and a spring to urge its closure; drive means for alternately pressure loading and unloading the driving fluid chamber; a diaphragm having a central body portion connected to an annular clamping portion by annular webbing; a protruding annular rib inside of the ridges, and sized to bite into the diaphragm before the ridges when the bodies are clamped together; means for adjusting the size of an opening between the driving fluid reservoir and the driving fluid chamber; means for adjusting the distance that the closure member can move away from the seat; a piston assembly including piston received within a cylinder having an upwardly facing sealing surface and adapted to be complementarily received with the upwardly facing sealing surface engaging a downwardly facing sealing surface of the upper pump body, a seal positioned between the two sealing surfaces, and adjustable securement means between the pump body and the cylinder for compressing the seal between the sealing surfaces.

24 Claims, 3 Drawing Sheets

DIAPHRAGM PUMP

FIELD OF THE INVENTION

The present invention relates to the field of dispensing apparatuses, and in particular to a diaphragm pump having a diaphragm assembly which resists distortion and uneven stress concentrations upon assembly, permitting adjustment of operational components to optimize efficiency, and facilitating servicing through ease of assembly and disassembly.

BACKGROUND OF THE INVENTION

In conventional diaphragm pumps for pumping viscous liquids such as paint, the first component to fail is frequently the diaphragm. In addition to the excessive wear imposed upon the diaphragm by being flexed to extremes usually in the range of 1725-2000 times per minute, one factor leading to premature failures in diaphragms is uneven localized stress concentrations created upon assembly of the pump. In one type of these pumps, the upper and lower pump housing portions which clamp and hold the annular periphery of the plastic diaphragm each define four or five mutually facing, cooperative, concentric, and annular gripping ridges. When a new diaphragm is to be installed, it is placed into position between the upper and lower housings and their mutually cooperating ridges. The housings are clamped tightly together with the ridges biting into, deforming and tightly clamping and sealing the corresponding annular periphery of the diaphragm. As the plastic of the diaphragm flows into the valleys between the ridges, the overall plastic flow is generally uncontrolled. That is, plastic flow radially inwardly from the innermost annular ridge may be greater at some areas than others. This often results in ripples and distortion in the inner portion of the diaphragm which results in uneven stress concentrations. Coupled with the high frequency reciprocal flexing, excessive stress concentrations localize at specific points in these areas, which results in premature failure. Adding to this structural debility is the imperfect manner in which the diaphragm is centered relative to the ridges and the corresponding pumping chambers within which the diaphragm reciprocates. For each increment of misalignment from a perfectly centered position, there is a correspondingly greater risk of resulting localized stress concentrations in the mounted diaphragm, and consequently, of premature failure.

Other problems commonly associated with diaphragm pumps of this type include complex disassembly for servicing and cleaning and difficulty in fine tuning the pump components for maximum performance and efficiency.

What is needed is a diaphragm pump which helps to prevent uneven stress concentrations in the diaphragm and which is easier to assemble, repair and operate.

SUMMARY OF THE INVENTION

Generally speaking, there is provided a diaphragm pump having a self-centering, nondistorting and pretensioning diaphragm assembly which promotes longer pump life. The pump generally includes a pump body, a diaphragm held by the pump body and separating a driving fluid chamber from a pump chamber, a driving fluid reservoir in the pump body and recurrently in communication with the driving fluid chamber through an opening, inlet and outlet passages to the pump chamber, a check valve between each passage and the pump chamber, drive means for alternately pressure loading and unloading driving fluid in the driving fluid chamber, and assemblies for adjusting the size of the opening and for adjusting the distance that the closure member in the outlet check valve can move away from its seat. The pump also provides an eccentric rotor assembly which is screwed onto its rotor shaft and held thereon without the need for any other retention device between it and the free end of the shaft. The pump further provides a breather hole assembly which resists entry or exit of liquids from the pump's fluid reservoir, and provides a piston assembly which defines the driving fluid chamber and which has means for maintaining a tight seal between the driving fluid chamber and the fluid reservoir during thermal expansion and contraction of the pump body. The pump described herein facilitates servicing because of a simplified assembly design.

It is an object of the present invention to provide an improved diaphragm pump.

It is another object of the present invention to provide a diaphragm pump having a diaphragm which resists experiencing localized stress concentrations upon assembly.

It is another object of the present invention to provide a pump which permits adjustment of operational components to optimized pump efficiency.

Other objects and advantages of the present invention will become apparent from the following description of the preferred embodiment.

DESCRIPTION OF THE PREFERRED EMBODIMENT

Figure 1:
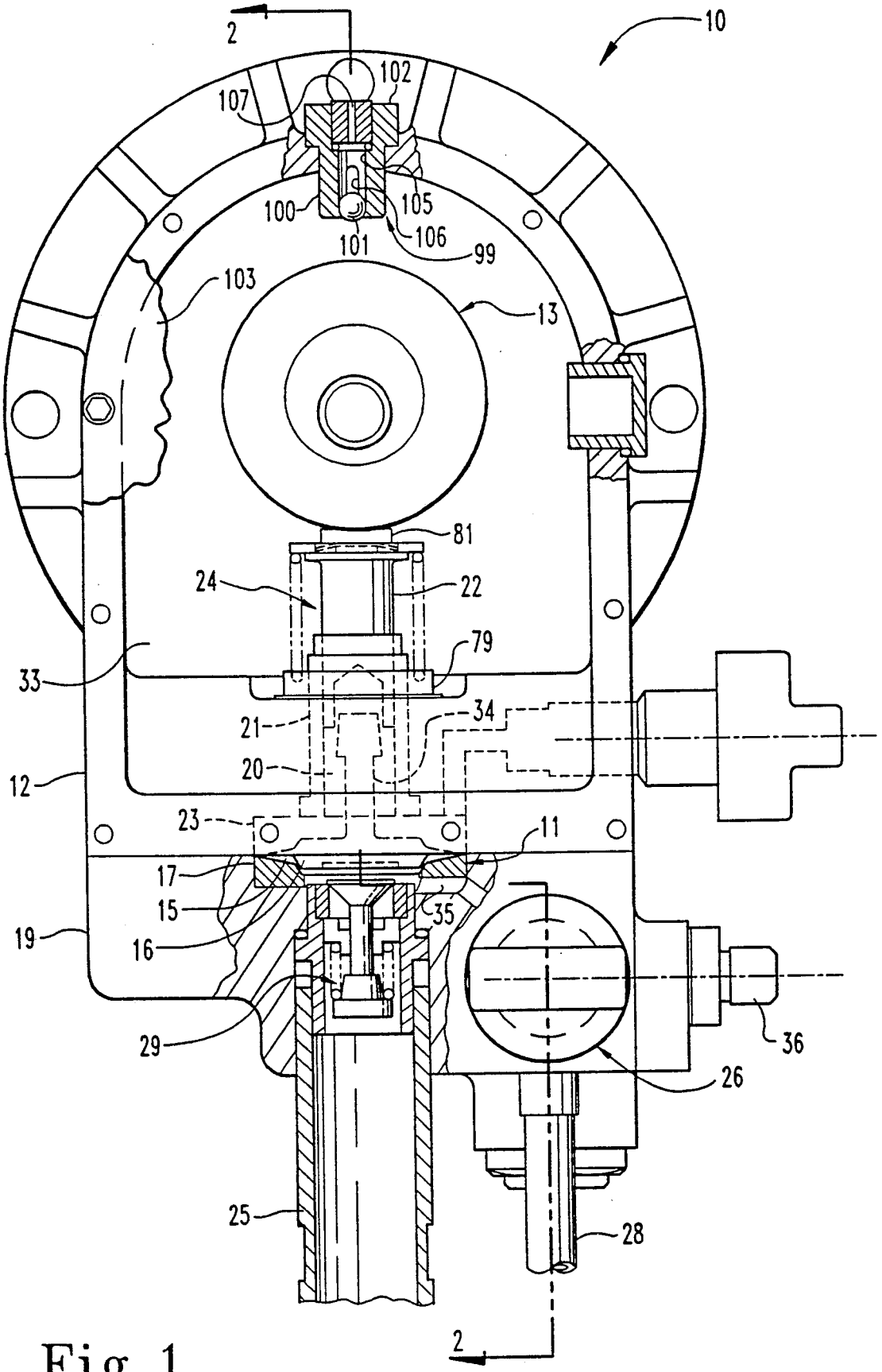
FIG. 1 is a diagrammatic front, vertical and partially cross-sectional view of a diaphragm according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
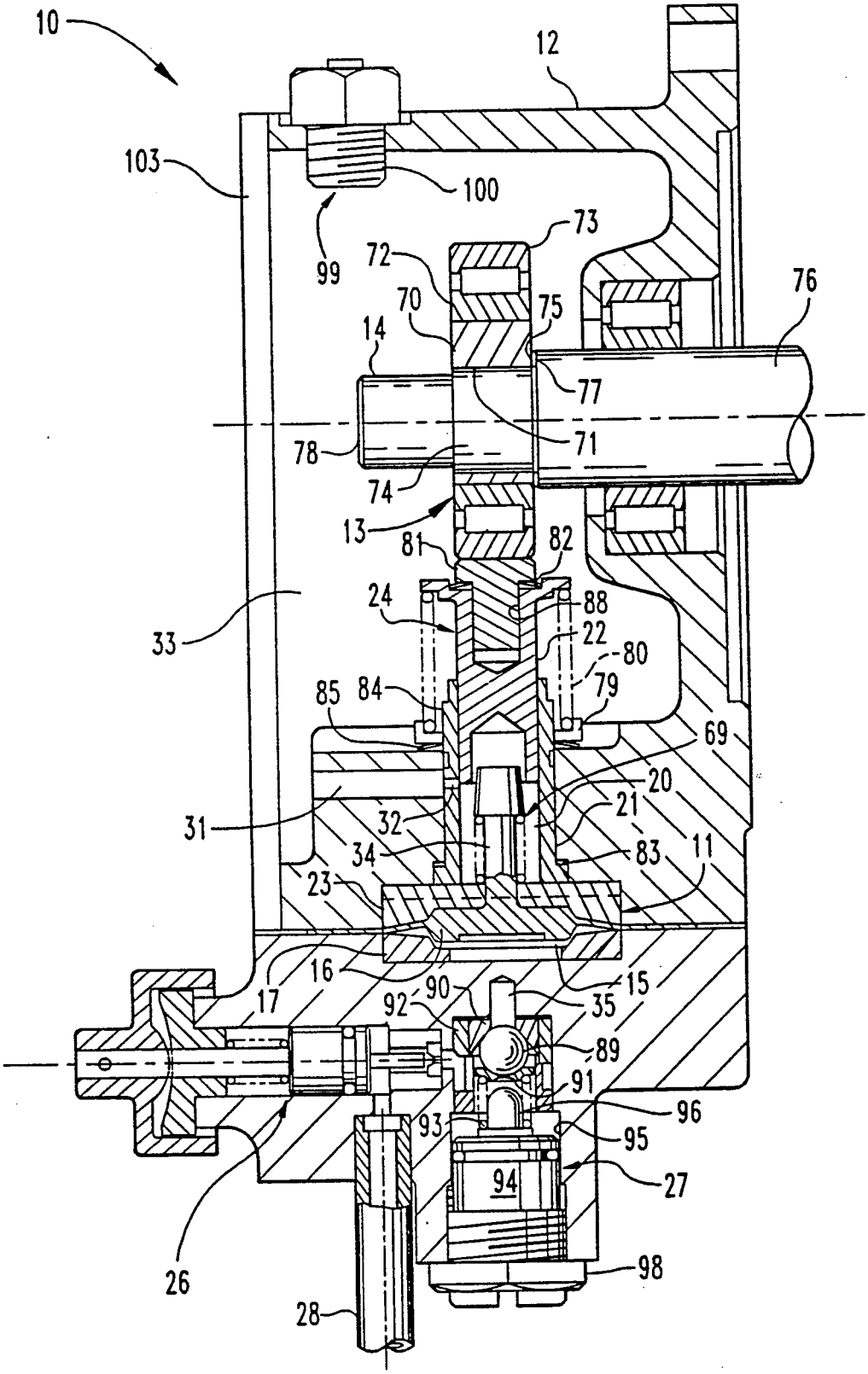
FIG. 2 is a diagrammatic side, vertical cross-sectional view of the pump of FIG. 1.

Referring to FIGS. 1 and 2, there is shown a diaphragm pump 10 in accordance with the preferred embodiment of the present invention. Generally, pump 10 includes an upper pump body or aluminum pump casing 12, a diaphragm assembly 11, and an eccentric rotor assembly 13 mounted on a shaft 14 which is driven by a motor (not shown), a lower pump body 19, and a piston assembly 24. A pump chamber 15 is defined by a flexible plastic diaphragm 16, a diaphragm insert washer 17 and pump body 19 which is rigidly attached to housing 12. A driving fluid chamber 20 for hydraulic fluid or the like is defined by diaphragm 16, diaphragm retainer 23 and piston assembly 24 which includes steel cylinder 21 and steel piston 22.

Fluid to be dispensed under pressure such as paint is supplied through inlet line 25 from a container positioned below pump 10. A primer valve 26 is provided from the outlet of check valve 27 to prime the paint flow and to allow selective return of fluid in inlet line 25 back to the paint container through return line 28. An inlet check valve 29 is provided between pump chamber 15 and inlet line 25 to permit only unidirectional fluid flow from line 25 into chamber 15.

Generally, pump 10 operates as follows: shaft 14 rotates eccentric bearing 13 which telescopically reciprocates piston 22 within steel cylinder 21. On the upstroke, piston 22 draws diaphragm 16 upward via its upper extension 34, and as piston 22 clears inlet slot 32 of steel cylinder 21, hydraulic fluid as needed is drawn from sump 33, through passageway 31 and slot 32, and into driving fluid chamber 20. On the downstroke, piston 22 closes inlet slot 32 and compresses the hydraulic fluid within chamber 20, which drives diaphragm 16 downward via its upper extension 34. The upward movement of diaphragm 16 draws paint through line 25, past check valve 29 and into pump chamber 15. The downstroke of diaphragm 16 compresses the paint within chamber 15, which closes check valve 29 and forces the paint through outlet passageway 35 which leads to check valve 27. The outlet 36 of check valve 27 is adapted to be connected to an appropriate tool such as a paint spray gun (not shown).

Diaphragm Assembly

Figure 3:
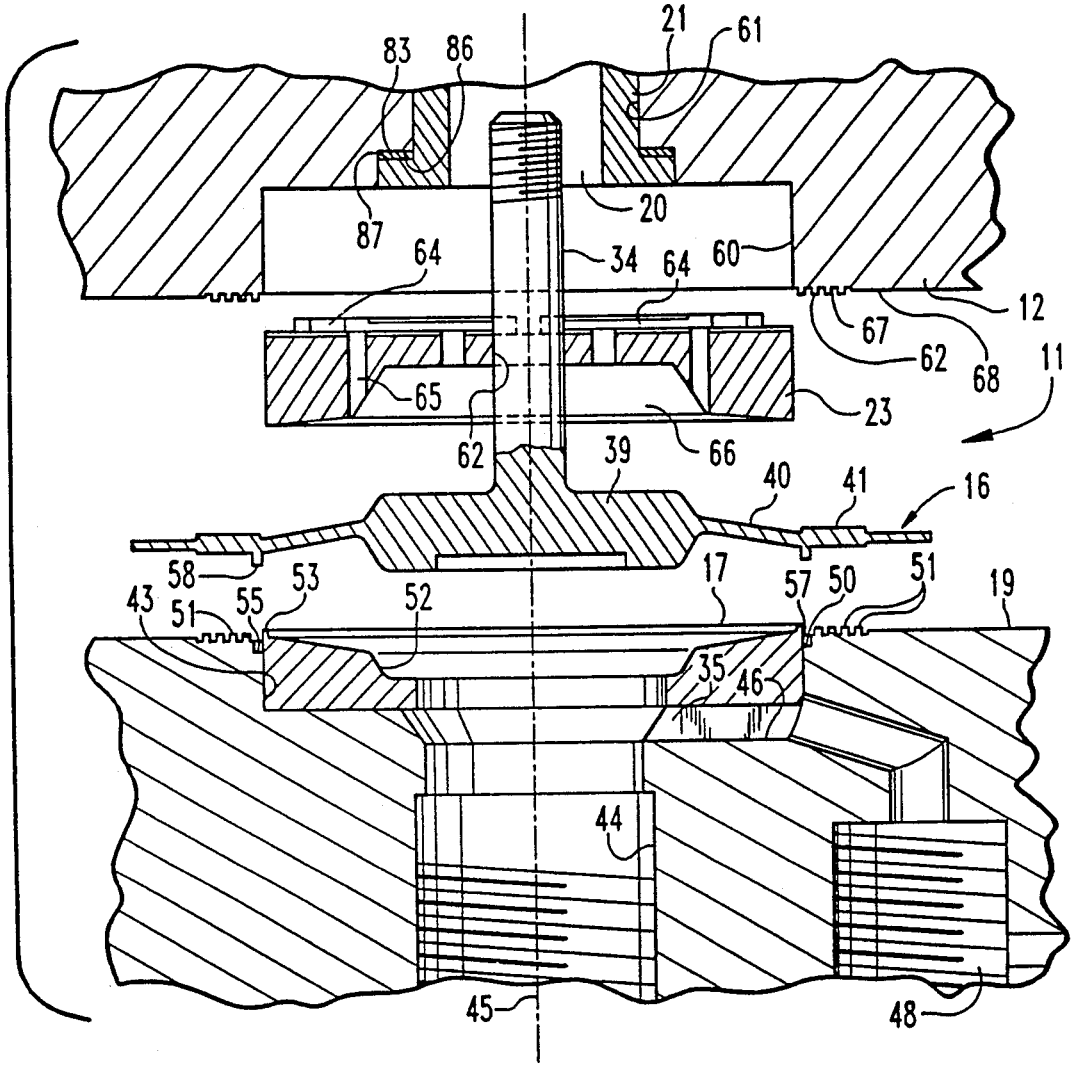
FIG. 3 is an enlarged exploded cross-sectional side view of the diaphragm assembly of the pump of FIG. 1.

In addition to FIGS. 1 and 2, FIG. 3 is provided which shows an exploded view of the diaphragm assembly 11. Diaphragm assembly 11 includes diaphragm 16, diaphragm insert washer 17, diaphragm retainer 23, aluminum casing 12 and pump body 19. Diaphragm 16 has a central body portion 39 integrally connected to axially extending upper extension 34 and to outwardly extending annular webbing 40, and from which outwardly extends thickened annular clamping portion 41. Body portion 39 defines a central recess 42 to provide clearance for the top of check valve 29 (FIG. 1) when diaphragm 16 reaches the lower apogee of its pumping stroke and is received within a complementary-shaped recess 52 of diaphragm insert washer 17.

Pump body 19 defines a circular recess 43 adapted to tightly receive diaphragm insert washer 17. Pump body 19 further defines threaded inlet passageway 44 adapted for receipt of inlet line 25. Passageway 44 communicates with recess 43 and is coaxial with both recess 43 and axis 45. Outlet passageway 35 is defined by a radially extending slot 46 milled into pump body 19 at the bottom of recess 43 and a passageway 47 which leads to threaded bore 48. Bore 48 receives check valve 27. Pump body 19 further defines a rectangular cross-sectioned shoulder or recess 50 at the junction of recess 43 and the top surface 54 of pump body 19. Pump body 19 also defines a series of protruding or upstanding, concentric annular gripping ridges 51 just outside of annular recess 50. The center of recess 50 and the common center of ridges 51 are both aligned on axis 45.

Diaphragm insert washer 17 is generally disc-shaped and is sized to be tightly received within circular recess 43 of pump body 19. Insert washer 17 defines an axial recess 52 which is shaped to complementarily receive diaphragm 16 during its downward, pumping stroke. An upstanding cylindrical rib 53 extends from the outer and upper periphery of insert washer 17 and circumscribes recess 52. In the present embodiment, with insert washer 17 firmly seated within circular recess 43, upstanding ridges 51 extend between 0.010 and 0.015 inches above top surface 54; base 55 of recess 50 is between 0.025 and 0.030 inches below top surface 54; and upstanding rib 53 extends between 0.023 and 0.030 inches above top surface 54, between 0.013 and 0.015 inches above ridges 51, and between 0.053 and 0.055 inches above base 55 of recess 50.

Generally, diaphragm 16 is self-centering, nondistorting and pretensioning. Diaphragm 16 includes an annular centering and plastic flow containment flange 58 which extends downwardly from the junction of webbing 40 and clamping portion 41. The inner diameter of flange 58 is approximately equal to the outer diameter of insert washer 17 at upstanding rib 53. In the present embodiment: the inner diameter of flange 58 is 2.0 inches; the outer diameter of insert 17 at rib 53 is between 1.998 and 2.0 inches; and, the axial height of flange 58 measured from the bottom of clamping portion 41 and from the bottom of webbing 40 at its junction 59 with flange 58 is 0.040 inches. The cross-section of flange 58 tapers slightly downwardly. The radial thickness of flange 58 is such that flange 58 is somewhat tightly received within the annular groove 57 defined by recess 50 and insert 17. That is, there is firm engagement between the inwardly facing cylindrical surface of flange 58 and the upwardly extending, outwardly facing cylindrical surface of insert 17 and its rib 53 which is exposed within groove 57.

Pump casing 12 defines a circular recess 60 and a communicating passageway 61, both of which, when aligned with pump body 19, are coaxial with axis 45. Passageway 60 receives steel cylinder 21 as will be described herein. Casing 12 further defines a set of downwardly extending and annular gripping ridges 62, all of which are concentrically aligned on axis 45 and which are aligned over the set of ridges 51 of pump body 19 when casing 12 and body 19 are aligned. Ridges 62 are actually formed by grooves 67 cut into the lower surface 68 of casing 12. Other embodiments are also contemplated wherein the manner in which ridges 51 and 62 are formed may vary. For example, ridges 51 may be formed by grooves cut into top surface 54 and ridges 62 may protrude or extend downwardly from lower surface 68. Retainer 23 is aluminum, generally disc-shaped, adapted for receipt into recess 60, and adapted to receive extension 34 of diaphragm 16 through its central opening 63. Retainer 23 defines a number of channels 64 and openings 65 to permit the free flow of hydraulic fluid between driving fluid chamber 20 and recess 66 of retainer 23. Recess 66 is shaped to complementarily receive diaphragm 16 therein during its upward, draw stroke. The outer diameter of retainer 23 is roughly the same as that of insert 17.

In assembly, with insert 17 firmly seated within recess 43, diaphragm 16 is positioned atop pump body 19 with centering flange 58 positioned within groove 57. Diaphragm 16 is now precisely centered atop body 19. That is, diaphragm 16 is coaxial with axis 45 and thickened clamping portion 41 is aligned above ridges 51. Retainer 23 is telescopically positioned upon diaphragm 16 followed by a spring and a cap 69 (FIG. 2). When pump casing 12 is positioned atop pump body 19, thickened clamping portion 41 is automatically positioned directly between sets of annular ridges 51 and 62; annular flange 58 is firmly seated within annular groove 57; and, annular rib 53 abuts the inside of flange 58 and contacts webbing 40 at junction 59. Because rib 53 extends upwardly higher from top surface 54 than do ridges 51, when casing 12 is started to be clamped onto pump body 19, rib 53 will contact and bite into webbing 40 at about junction 59 before ridges 51 (and 62) significantly bite into and deform the plastic of clamping portion 41. As casing 12 and body 19 are clamped tighter together, sets of ridges 51 and 62 bite into, deform and hold clamping portion 41. Instead of the plastic flowing unevenly inwardly, causing ripples and uneven and localized stress concentrations in webbing 40 as with other designs, inward plastic flow created in the present embodiment by the compression of the multiple ridges 51 is severely limited if not halted by some combination of the upwardly biting, single rib 53 and by flange 58 abutting rib 53.

Rotor and Piston Assembly

Referring to FIG. 2, rotor assembly 13 includes an eccentric 70, an inner bearing race 72 connected by pressure fit to eccentric 70, and an outer bearing race 73. Shaft 14 has a free end 78 and a threaded, reduced diameter segment 74 which defines a shoulder 75 between it and the adjacent, larger diameter motor-driven end 76. Eccentric 70 is internally threaded. Instead of a nut, circlip or other conventional fastening means, rotor assembly 13 is secured onto shaft 14 by screwing it, via internally threaded eccentric 70, onto threaded segment 74 and against a copper washer 77 disposed between eccentric 70 and shoulder 75. The threads of eccentric 70 and segment 74 are oriented such that, in the present embodiment, the motor (not shown) rotates shaft 14 clockwise during operation (as viewed in FIG. 1), and rotor assembly 13 is screwed onto shaft 14 counterclockwise. During normal operation, the clockwise rotation of shaft 14 continually urges rotor assembly 13 tighter. Copper washer 77 helps keep rotor assembly from shaking loose or backing off shaft 14 during deceleration or externally induced movement such as transport. Rotor assembly 13 may be removed for service simply by turning it clockwise relative to shaft 14 (as viewed in FIG. 1).

Passageway 61 has a larger diameter at its lower end which defines a shoulder with a downwardly facing sealing surface 86 (FIGS. 2 and 3). Complementary-shaped cylinder has a radial flange which defines an upwardly facing sealing surface 87. Piston assembly 24, which is driven by rotor assembly 13, includes steel cylinder 21, steel piston 22, cylinder retaining nut 79, spring 80, adjusting screw 81 and Belleville spring washer 82. A nylon sealing washer 83 is coaxially disposed between sealing surfaces 86 and 87. The upper end 84 of cylinder 21 is externally threaded. An internally threaded retaining nut 79 is screwed onto externally threaded upper end 84 over a Belleville spring washer 85 and moderately tightened thereon. This axially compresses nylon washer 83 between casing 12 and cylinder 21 and forms a seal thereat. Belleville spring washer 85, seated around steel cylinder 21 and between casing 12 and retaining nut 79, will encounter and resist further tightening of nut 79 before nut 79 is tightened all the way. Proper assembly, therefore, has nut 79 tightened less than all the way. During operation of pump 10, pump casing 12 will expand and contract in response to temperature variations. Belleville washer 85 allows for this expansion and contraction of the components and assures that nylon washer 83 will maintain a tight seal between steel cylinder 21 and housing 12.

The upper end of piston 22 defines a threaded bore 88 within which is screwed adjusting screw 81, the top of which acts as a follower to the cam action of outer bearing race 73. Belleville spring washer 82 is coaxially disposed between the head of screw 81 and a complementary recess in the top of piston 22 to hold screw 81 in its desired, adjusted position which is reached simply by rotating screw 81 in or out of bore 88. Slot 32 in cylinder 21 extends laterally about 0.250 inches and has an axial height of about 0.070 inches. Rotating screw 81 in or out of bore 88 defines the upper limit of reciprocation of piston 22 and therefore modifies the actual size of opening of driving fluid chamber inlet slot 32 as well as the timing and duration of opening of slot 32. In the present embodiment, screw 81 is adjusted to occlude the upper 0.052 inches of slot 32, thereby allowing slot 32 to open a maximum of 0.018 inches when piston 22 is at the top of its stroke. Spring 80 constantly urges piston 21 upward, and the head of adjusting screw 81 is hexagonal to permit easy adjustment without requiring disassembly of rotor assembly 13.

The efficiency of pump 10 is directly related to the opening permitted by slot 32. If the opening is too large, pump 10 can become inefficient as a spray gun, connected to outlet 36, is opened and internal pressures fall below a pre-set spring pressure. Also, priming of the hydraulic fluid can become very difficult. Further, small manufacturing variations in part sizing can affect the size of slot 32, and one pump may be more or less efficient than another otherwise identical pump. The ability to adjust the opening of slot 32 in the present embodiment permits maximum efficiency to be achieved more readily and without requiring a parts change or complicated disassembly. The present design also enhances the ease of repairing the pump in the field because the majority of the parts are axially assembled and held thereat by only a few screwed-on parts. Disassembly and repair is thereby facilitated.

Check Valve

Referring to FIG. 2, check valve 27 is adapted for adjustment to account for varying viscosities of the pumped fluid. Check valve 27 includes ball 89, seat 90, nylon ball retaining member 91, insert 92, spring 93, and externally threaded adjuster post 94, all received within check valve bore 95 of pump body 19. Post 94 is threadedly received within bore 95 for vertical adjustment therein. A lock nut 98 or other appropriate means is provided to lock post 94 in the desired position. A nub 96 extends axially upwardly from post 94 and defines the lower limit that ball 89 can move away from and open seat 90. Spring 93 surrounds nub 96 and axially extends between post 94 and retaining member 91. Retaining member 91 is generally annular and defines a central recess on its top within which ball 89 stays seated via the axial bias of spring 93. Retaining member 91 also defines a recess in its bottom for complementary engagement with shaped nub 96.

I have found that it is desirable to have check valve 27 close as quickly as possible to preclude pumped fluid backflow which would then have to be re-pumped when pumping resumes. Thus, ball 89 should be allowed to open only as far as necessary to achieve the desired flow rate. However, as the viscosity of the fluid to be pumped increases, so does the distance that ball 89 should be allowed to move away from seat 90 to achieve the desired flow rate. To account for these varying viscosities and achieve a more efficient operation, post 94 and nub 96 may be axially adjusted, the axial position of nub 96 defining the lower limit of travel of ball 89, and therefore the amount of opening of check valve 27.

Breather Hole Assembly

Pump 10 includes a breather hole assembly 99 which includes a breather hole screw 100, ball 101 and plug 102. Screw 100 is screwed into a threaded hole in the top of pump casing 12 and proximal to front plate 103 of casing 12 (FIG. 2). At its lower end, screw 100 includes a gravity actuated check valve having a central check valve passageway 105 within which a ball 101 floats. The diameter of passageway 105 is reduced at its bottom to hold ball 101 therein. A transverse slot 106 is defined part of the way up from the bottom of screw 101, providing communication between passageway 105 and the outside of screw 101. At the top of screw 101, passageway 105 is adapted for threaded receipt of a plug 102. An o-ring is seated between plug 102 and the ledge defined at the intersection of different diameter portions of passageway 105. Plug 102 defines a central, breather passageway 107 which is only roughly 0.03 inches in diameter. I have found this diameter to be adequate to permit the passage of air or gases in or out of sump 33 as necessary to account for varying internal temperature changes during operation, but adequately small to substantially preclude entry or exit of liquid through passageway 107.

During operation, as the temperature of pump 10 and the hydraulic driving fluid increases, the internal pressure of the gases within sump 33 also increases. Typically, in pumps of this type, the motor shaft seals are inadequate and permit leakage of hydraulic fluid precipitated by the high internal pressures. Breather hole assembly 99 permits sump 33 to breathe in response to temperature fluctuations. Gases may pass around ball 101, through slot 106, check valve passageway 105 and breather passageway 107, but will substantially preclude hydraulic liquid from exiting and foreign liquids from entering in the same manner. Also assisting in precluding exit of hydraulic fluid through breather assembly 99 is the fact that assembly 99 is mounted close to front plate 103 of pump 10. (See FIG. 2). Assembly 99 is thus moved farther from potential splashing from the rotation of rotor assembly 13 during operation. This positioning of assembly 99 also reduces splashing during transport whereby pump 10, as it is attached to a motor and a standard transport cart, is tilted or rotated clockwise as shown in FIG. 2. If pump 10 is rotated to a completely horizontal plane, ball 101 moves upwardly through bore 105 and against the bottom of plug 102 to close off passageway 107 at its bottom, thereby closing breather hole assembly 99 from the exit of hydraulic fluid.

Other embodiments are contemplated wherein the elements of the diaphragm assembly 11 are assembled in different locations. For example, protruding ridges 51 may extend down from aluminum casing 12 and the complementary ridges may be formed in pump body 19 by cutting of grooves therein. Also, diaphragm retainer 23 may be formed with a rib to engage with diaphragm 16 to help center diaphragm 16 and/or bite into diaphragm 16 to retard inward plastic flow during assembly. And, an embodiment is contemplated wherein diaphragm 16 would be provided with an upwardly extending, annular flange to engage with retainer 23.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a diaphragm pump having mating upper and lower pump bodies adapted to clamp a diaphragm therebetween which separates a driving fluid chamber in the upper body from a pump chamber in the lower body, inlet and outlet passages to the pump chamber, check valves between the pump chamber and both the inlet passage and the outlet passage, and drive means for alternately pressure loading and unloading driving fluid in the driving fluid chamber, a diaphragm assembly, comprising:

a diaphragm having a central body portion and an annular clamping portion connected to the body portion by an annular webbing portion;

a diaphragm retainer seatable within a recess in an upper pump body and adapted to receive said diaphragm in a complementary shaped recess during pressure unloading;

a diaphragm insert washer having an outer cylindrical surface, being seatable within a recess in a lower pump body and adapted to receive said diaphragm in a complementary shaped recess during pressure loading; and, diaphragm deformation restraining means in at least one of said diaphragm, said retainer and said insert washer for restraining radially inward flow of diaphragm material when the upper and lower pump bodies clamp a diaphragm therebetween, thereby compressing and deforming the clamping portion of said diaphragm.

2. In a diaphragm pump having mating upper and lower pump bodies adapted to clamp a diaphragm therebetween which separates a driving fluid chamber in the upper body from a pump chamber in the lower body, inlet and outlet passages to the pump chamber, check valves between the pump chamber and both the inlet passage and the outlet passage, and drive means for alternately pressure loading and unloading driving fluid in the driving fluid chamber, a diaphragm assembly, comprising:

a diaphragm having a central body portion and an annular clamping portion connected to the body portion by an annular webbing portion;

a diaphragm retainer seatable within a recess in an upper pump body and adapted to receive said diaphragm in a complementary shaped recess during pressure unloading;

a diaphragm insert washer having an outer cylindrical surface, being seatable within a recess in a lower pump body and adapted to receive said diaphragm in a complementary shaped recess during pressure loading; and, diaphragm deformation restraining means in at least one of said diaphragm, said retainer and said insert washer for restraining radially inward flow of diaphragm material when the upper and lower pump bodies clamp a diaphragm therebetween, thereby compressing and deforming the clamping portion of said diaphragm;

wherein the upper pump body defines a lower surface which surrounds its recess and the lower pump body defines an upper surface which surrounds its recess, and wherein at least one of the upper and lower pump bodies defines at least one protruding ridge having a height relative to its surface and substantially surrounding its recess, wherein the at least one ridge bites into and deforms the clamping portion when the bodies are clamped together, and wherein said diaphragm deformation retraining means includes one of said retainer and said insert washer defining a protruding annular rib which, when said retainer and insert washer are seated in their respective recesses and the bodies are clamped together, is concentric with and inside of the at least one protruding ridge and has a height relative to the surface of the one of said retainer and said insert washer in which it sits, the relative height of the annular rib, the relative height of the at least one ridge, and the shape of said diaphragm being such that, upon clamping said diaphragm between the upper and lower pump bodies, the annular rib contacts and bites into said diaphragm before the at least one protruding ridge contacts and bites into said diaphragm.

3. The diaphragm assembly of claim 2 wherein the at least one protruding ridge extends upwardly from the lower body and the rib is defined by and extends upwardly from said insert washer and bites into said diaphragm at roughly a junction defined between the webbing portion and the clamping portion.

4. The diaphragm assembly of claim 3 wherein said diaphragm defines an annular flange extending downwardly from said junction, said flange sized to telescopically surround the upwardly protruding rib of said insert washer.

5. The diaphragm assembly of claim 4 wherein the lower pump body defines an annular shoulder surrounding and in communication with the recess of the lower body, and wherein said flange is sized to be received within the annular groove defined by the shoulder and the outer cylindrical surface of said insert washer.

6. The diaphragm assembly of claim 4 wherein, when said insert washer is seated within the recess in the lower body, the rib extends upwardly between 0.013 and 0.015 inches above the ridges in the lower body.

7. The diaphragm assembly of claim 1 wherein at least one of the upper and lower pump bodies defines at least one protruding ridge substantially surrounding its recess, wherein the at least one ridge bites into and deforms the clamping portion when the bodies are clamped together, and wherein said diaphragm defines an annular flange extending downwardly from a junction defined between the webbing portion and the clamping portion, and wherein said flange is sized to telescopically surround the upper portion of the cylindrical surface of said insert washer.

8. In a diaphragm pump having mating upper and lower pump bodies adapted to clamp a diaphragm therebetween which separates a driving fluid chamber in the upper body from a pump chamber in the lower body, inlet and outlet passages to the pump chamber, check valves between the pump chamber and both the inlet passage and the outlet passage, and drive means for alternately pressure loading and unloading driving fluid in the driving fluid chamber, a diaphragm assembly, comprising:

a diaphragm having a central body portion and an annular clamping portion connected to the body portion by an annular webbing portion;

a diaphragm retainer seatable within a recess in an upper pump body and adapted to receive said diaphragm in a complementary shaped recess during pressure unloading;

a diaphragm insert washer having an outer cylindrical surface, being seatable within a recess in a lower pump body and adapted to receive said diaphragm in a complementary shaped recess during pressure loading; and, diaphragm deformation restraining means in at least one of said diaphragm, said retainer and said insert washer for restraining radially inward flow of diaphragm material when the upper and lower pump bodies clamp a diaphragm therebetween, thereby compressing and deforming the clamping portion of said diaphragm;

wherein at least one of the upper and lower pump bodies defines at least one protruding ridge substantially surrounding its recess, wherein the at least one ridge bites into and deforms the clamping portion when the bodies are clamped together, and wherein said diaphragm defines an annular flange extending downwardly from a junction defined between the webbing portion and the clamping portion, and wherein said flange is sized to telescopically surround the upper portion of the cylindrical surface of said insert washer; and wherein the lower body defines an annular shoulder surrounding and in communication with the recess of the lower body, and wherein said flange is sized to be firmly received within an annular groove defined by the shoulder and the outer cylindrical surface of said insert washer.

9. The diaphragm assembly of claim 1 wherein said restraining means includes a single unique annular rib extending up from said insert washer or down from said retainer and operable to bite into said diaphragm upon clamping the upper and lower pump bodies together.

10. A diaphragm pump, comprising:

mating upper and lower pump bodies adapted to clamp a diaphragm therebetween which separates a driving fluid chamber in the upper body from a pump chamber in the lower body, at least one of said bodies defining at least one protruding ridge substantially surrounding its chamber;

inlet and outlet passages to the pump chamber;

a check valve between each passage and the pump chamber;

drive means for alternately pressure loading and unloading driving fluid in the driving fluid chamber;

a diaphragm having a central body portion and an annular clamping portion connected to the body portion by an annular webbing portion;

wherein the at least one protruding ridge is adapted to bite into, deform and hold the clamping portion when the bodies are clamped together; and a protruding annular rib fixed relative to one of said upper and lower bodies, said rib positioned interiorly of said at least one ridge, and wherein the upper pump body defines a lower surface and the lower pump body defines an upper surface, and wherein said at least one protruding ridge has a height relative to the surface of the one of said upper and lower bodies and said protruding annular rib has a height relative to the surface of the one of said upper and lower bodies, the relative height of the annular rib, the relative height of the at least one ridge, and the shape of said diaphragm being such that, upon clamping said diaphragm between the upper and lower pump bodies, the annular rib contacts and bites into said diaphragm before the at least one protruding ridge contacts and bites into said diaphragm.

11. The diaphragm pump of claim 10 wherein said at least one ridge extends upwardly from said lower body.

12. A diaphragm pump, comprising:

mating upper and lower pump bodies adapted to clamp a diaphragm therebetween which separates a driving fluid chamber in the upper body from a pump chamber in the lower body, at least one of said bodies defining at least one protruding ridge substantially surrounding its chamber;

inlet and outlet passages to the pump chamber;

a check valve between each passage and the pump chamber;

drive means for alternately pressure loading and unloading driving fluid in the driving fluid chamber;

a diaphragm having a central body portion and an annular clamping portion connected to the body portion by an annular webbing portion;

wherein the at least one protruding ridge is adapted to bite into, deform and hold the clamping portion when the bodies are clamped together;

a protruding annular rib fixed relative to one of said upper and lower bodies, said rib positioned interiorly of said at least one protruding ridge and sized to bite into said diaphragm before said at least one ridge;

wherein said ridge extends upwardly from said lower body; and a diaphragm insert washer having an outer cylindrical surface and seated within a recess in said lower body and wherein said rib is integral with and extends upwardly from said insert washer;

wherein the upper pump body defines a lower surface and the lower pump body defines an upper surface which surrounds its recess, and wherein said at least one protruding ridge has a height relative to the upper surface and said protruding annular rib has a height relative to the surface of the one of said upper and lower bodies, the relative height of the annular rib, the relative height of the at least one ridge, and the shape of said diaphragm being such that, upon clamping said diaphragm between the upper and lower pump bodies, the annular rib contacts and bites into said diaphragm before the at least one protruding ridge contacts and bites into said diaphragm.

13. The diaphragm pump of claim 12 wherein said diaphragm defines an annular flange extending downwardly from the junction defined between the webbing portion and the clamping portion and sized to telescopically surround the upper portion of said upwardly protruding rib.

14. The diaphragm pump of claim 13 wherein said lower pump body defines an annular shoulder surrounding and in communication with the recess of the lower body and inside of said at least one ridge, and wherein said flange is adapted to be received within an annular groove defined by the shoulder and the outer cylindrical surface of said insert washer.

15. The diaphragm pump of claim 13 wherein said rib is adapted to bite into said diaphragm at the junction and just inside of the flange.

16. The diaphragm pump of claim 14 wherein, when said insert washer is seated within the recess in the lower body, said rib extends upwardly between 0.013 and 0.015 inches above said at least one ridge in the lower body.

17. The diaphragm pump of claim 11 further including a diaphragm retainer seated within a recess in said upper body and adapted to receive said diaphragm in a complementary shaped recess during pressure unloading, said retainer adapted to form a backup for said diaphragm as said rib bites into said diaphragm when said bodies are clamped together.

18. The diaphragm pump of claim 12 wherein said lower body defines at least two upwardly extending ridges substantially surrounding its chamber and said upper body defines at least two ridges substantially surrounding its chamber, said at least two ridges of both said upper and lower bodies cooperating to clamp said diaphragm at its clamping portion when said bodies are clamped together.

19. The diaphragm pump of claim 12 wherein said diaphragm includes downwardly extending centering means for engaging with said rib and centering said diaphragm over said insert washer and pump chamber.

20. A diaphragm pump, comprising:

mating upper and lower pump bodies adapted to clamp a diaphragm therebetween which separates a driving fluid chamber in the upper body from a pump chamber in the lower body, the upper and lower pump bodies defining lower and upper surfaces, respectively, which mutually engage and surround the driving fluid chamber when said bodies are clamped together, and at least one of said bodies defining at least one protruding ridge substantially surrounding its chamber;

inlet and outlet passages to the pump chamber;

a check valve between each passage and the pump chamber;

drive means for alternately pressure loading and unloading driving fluid in the driving fluid chamber;

a diaphragm having a central body portion and an annular clamping portion connected to the body portion by an annular webbing portion;

wherein the at least one protruding ridge is adapted to bite into, deform and hold the clamping portion when the bodies are clamped together; and, centering means in said diaphragm and said lower pump body for substantially precisely locating said diaphragm in coaxial alignment with said lower pump body, said centering means including a flange extending downwardly from said diaphragm and engaging with a flange engaging surface of said lower body which extends upwardly of the top surface of the lower body.

21. The diaphragm pump of claim 20 wherein the flange is cylindrical and wherein said lower body includes a diaphragm insert washer defining a generally cylindrical flange engaging surface.

22. In a diaphragm pump having mating upper and lower pump bodies adapted to clamp a diaphragm therebetween which separates a driving fluid chamber in the upper body from a pump chamber in the lower body, inlet and outlet passages to the pump chamber, check valves between the pump chamber and both the inlet passage and the outlet passage, and drive means for alternately pressure loading and unloading driving fluid in the driving fluid chamber, a diaphragm assembly, comprising:

a diaphragm having a central body portion and an annular clamping portion connected to the body portion by an annular webbing portion;

a diaphragm retainer seatable within a recess in an upper pump body and adapted to receive said diaphragm in a complementary shaped recess during pressure unloading;

a diaphragm insert washer having an outer cylindrical surface, being seatable within a recess in a lower pump body and adapted to receive said diaphragm in a complementary shaped recess during pressure loading; and, wherein the upper pump body defines a lower surface which surrounds its recess and the lower pump body defines an upper surface which surrounds its recess, and wherein at least one of the upper and lower pump bodies defines at least one protruding ridge having a height relative to its surface and substantially surrounding its recess, wherein the at least one ridge bites into and deforms the clamping portion when the bodies are clamped together, and wherein one of said retainer and said insert washer defines a protruding annular rib which, when said retainer and insert washer are seated in their respective recesses and the bodies are clamped together, is concentric with and inside of the at least one protruding ridge and has a height relative to the surface of the one of said retainer and said insert washer in which it sits, the relative height of the annular rib being greater than the relative height of the at least one ridge.

23. A diaphragm pump, comprising:

mating upper and lower pump bodies adapted to clamp a diaphragm therebetween which separates a driving fluid chamber in the upper body from a pump chamber in the lower body;

inlet and outlet passages to the pump chamber;

check valves between the pump chamber and both the inlet passage and the outlet passage;

drive means for alternately pressure loading and unloading driving fluid in the driving fluid chamber;

a diaphragm having a central body portion and an annular clamping portion connected to the body portion by an annular webbing portion; and, diaphragm deformation restraining means for restraining radially inward flow of diaphragm material when the upper and lower pump bodies clamp a diaphragm therebetween, thereby compressing and deforming the clamping portion of said diaphragm, said restraining means including a single, uniquely sized annular rib extending up from said lower pump body or down from said upper pump body and operable to bite into said diaphragm upon said upper and lower pump bodies being clamped together.

24. A diaphragm pump, comprising:

mating upper and lower pump bodies adapted to clamp a diaphragm therebetween which separates a driving fluid chamber in the upper body from a pump chamber in the lower body, the upper and lower pump bodies defining lower and upper surfaces, respectively, which mutually engage and surround the driving fluid chamber when said bodies are clamped together, and at least one of said bodies defining at least one protruding ridge substantially surrounding its chamber;

inlet and outlet passages to the pump chamber;

a check valve between each passage and the pump chamber;

drive means for alternately pressure loading and unloading driving fluid in the driving fluid chamber;

a diaphragm having a central body portion and an annular clamping portion connected to the body portion by an annular webbing portion, said diaphragm defining a junction at the intersection of the webbing portion and the clamping portion;

wherein the at least one protruding ridge is adapted to bite into, deform and hold the clamping portion when the bodies are clamped together; and, centering means in said diaphragm and said lower pump body for substantially precisely locating said diaphragm in coaxial alignment with said lower pump body, said centering means including an annular flange extending downwardly from the junction of said diaphragm.

* * * * *